US009419342B2

(12) United States Patent
Chen et al.

(10) Patent No.: US 9,419,342 B2
(45) Date of Patent: Aug. 16, 2016

(54) LOW NOISE BLOCK CONVERTER AND OUTDOOR UNIT

(71) Applicant: MICROELECTRONICS TECHNOLOGY, INC., Hsinchu (TW)

(72) Inventors: Ruei Yuen Chen, Toufen Township (TW); Hsiang Hao Sung, Zhunan Township (TW); Wen Chi Fu, Beipu Township (TW)

(73) Assignee: MICROELECTRONICS TECHNOLOGY, INC., Hsinchu (TW)

( * ) Notice: Subject to any disclaimer, the term of this patent is extended or adjusted under 35 U.S.C. 154(b) by 144 days.

(21) Appl. No.: 14/506,305

(22) Filed: Oct. 3, 2014

(65) Prior Publication Data

US 2016/0099503 A1 Apr. 7, 2016

(51) Int. Cl.

| | |
|---|---|
| ***H01Q 13/00*** | (2006.01) |
| ***H01Q 13/02*** | (2006.01) |
| ***H01Q 19/13*** | (2006.01) |
| ***H01Q 19/17*** | (2006.01) |

(52) U.S. Cl.
CPC ..... *H01Q 13/02* (2013.01); *H01Q 19/132* (2013.01); *H01Q 19/17* (2013.01)

(58) Field of Classification Search
CPC ..... H01Q 13/02; H01Q 19/132; H01Q 19/17
USPC ..... 343/776, 784, 786
See application file for complete search history.

(56) References Cited

U.S. PATENT DOCUMENTS

| | | | | |
|---|---|---|---|---|
| 6,111,547 | A * | 8/2000 | Gau | H01Q 1/247 343/776 |
| 2002/0142795 | A1* | 10/2002 | Imahori | H04M 1/035 455/550.1 |
| 2010/0285758 | A1* | 11/2010 | Laidig | H01Q 1/247 455/90.3 |

* cited by examiner

*Primary Examiner* — Dieu H Duong
(74) *Attorney, Agent, or Firm* — Hamre, Schumann, Mueller & Larson P.C.

(57) ABSTRACT

An outdoor unit includes a dish antenna and a low noise block converter positioned at a focus point of the dish antenna. The low noise block converter comprises a housing, a feed cap disposed on top of the housing, and an air permeable membrane disposed on a bottom portion of the housing. The housing includes a base portion, at least one feed horn protruding from the base portion, and a bottom cover attached to a bottom of the base portion so as to form a housing cavity, wherein the bottom cover has a vent hole forming a flow path between the housing cavity and an external environment. The feed cap is disposed on a feed portion of the at least one feed horn and the air permeable membrane is disposed over the vent hole and coupled to the bottom cover via an adhesive, wherein the membrane is configured to permit egress of a gas from the housing cavity therethrough.

20 Claims, 17 Drawing Sheets

Ka 99

LOW NOISE BLOCK CONVERTER AND OUTDOOR UNIT

TECHNICAL FIELD

The present disclosure relates to a low noise block converter and an outdoor unit and more particularly to a low noise block converter and an outdoor unit having a consistent communication quality.

DISCUSSION OF THE BACKGROUND

Satellite communications require equipment such as ground stations, low noise block down converters, transmission cables, and modulator/demodulators. The ground station receives radio frequency signals from satellites; the low noise block down converter amplifies the received radio frequency signals and converts the amplified radio frequency signals to intermediate frequency signals; and the transmission cables transmit the intermediate signals to the modulator/demodulator.

Generally, the low noise block down converter may include a radio frequency circuit and an intermediate circuit electrically connecting to the radio frequency circuit. The radio frequency circuit receives radio frequency signals, converts the radio frequency signals to intermediate signals, and transmits the intermediate signals to the intermediate circuit.

The ground station uses a highly directional receiving device, i.e., dish antenna, which has to be precisely directed toward satellites in orbit at 36,000 kilometers in altitude. For example, if a dish antenna with a 180 cm diameter shifts 2 cm horizontally, or 3 cm vertically, the signals will become weak or even disappear. In addition, if the dish antenna is configured to use electromagnetic waves in a frequency band of 26-40 GHz, an accuracy of 0.1 degree is needed, and the tolerance has to be within 0.02 degrees for aiming precisely at satellites.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY

One aspect of the present disclosure provides a low noise block converter and an outdoor unit having a consistent communication quality.

A low noise block converter comprises a housing, a feed cap disposed on top of the housing, and an air permeable membrane disposed on a bottom portion of the housing. The housing includes a base portion, at least one feed horn protruding from the base portion, and a bottom cover attached to a bottom of the base portion so as to form a housing cavity, wherein the bottom cover has a vent hole forming a flow path between the housing cavity and an external environment. The feed cap is disposed on a feed portion of the at least one feed horn and the air permeable membrane is disposed over the vent hole and coupled to the bottom cover via an adhesive, wherein the membrane is configured to permit egress of a gas from the housing cavity therethrough.

An outdoor unit comprises a dish antenna and a low noise block converter positioned at a focus point of the dish antenna. The low noise block converter comprises a housing, a feed cap disposed on top of the housing, and an air permeable membrane disposed on a bottom portion of the housing. The housing includes a base portion, at least one feed horn protruding from the base portion, and a bottom cover attached to a bottom of the base portion so as to form a housing cavity, wherein the bottom cover has a vent hole forming a flow path between the housing cavity and an external environment. The feed cap is disposed on a feed portion of the at least one feed horn and the air permeable membrane is disposed over the vent hole and coupled to the bottom cover via an adhesive, wherein the membrane is configured to permit egress of a gas from the housing cavity therethrough.

Due to the design for the bottom cover with the vent hole forming the flow path between the housing cavity and the external environment, the height variation of the feed cap caused by the air pressure imbalance between the housing cavity and the environment can be decreased. Consequently, the electronic characteristics of the low noise block converter and the outdoor unit can be well controlled so as to have a consistent communication quality even if the temperature or pressure of the environment changes.

The foregoing has outlined rather broadly the features and technical advantages of the present disclosure in order that the detailed description of the disclosure that follows may be better understood. Additional features and advantages of the disclosure will be described hereinafter, which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

The present disclosure is directed to a low noise block converter and an outdoor unit having consistent communication quality. In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
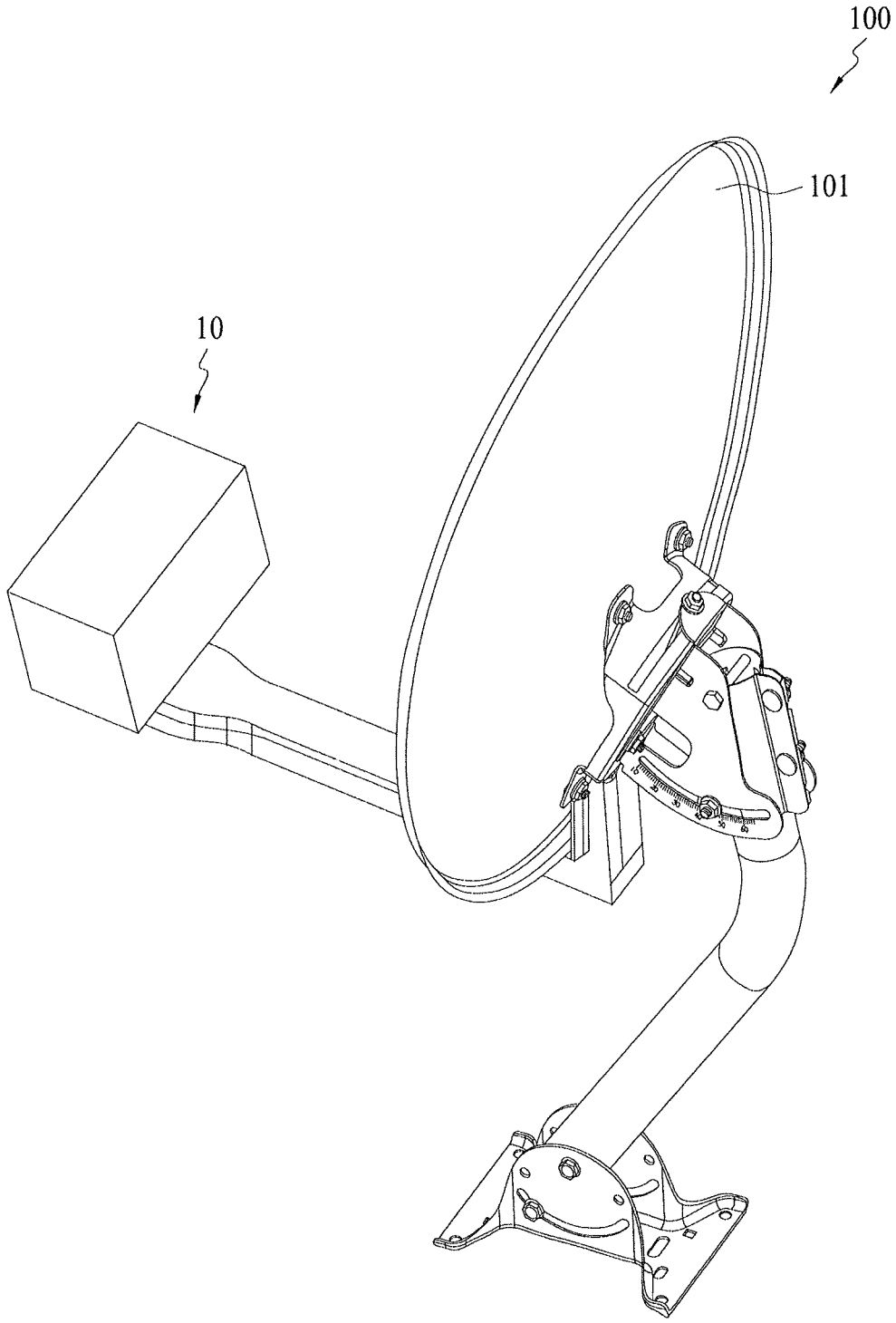
FIG. 1 shows a three-dimensional view of an outdoor unit according to one embodiment of the present invention.

FIG. 1 shows a three-dimensional view of an outdoor unit 100 according to one embodiment of the present invention. In one embodiment of the present disclosure, the outdoor unit 100 comprises a dish antenna 101 and a low noise block converter 10 positioned at a focus point of the dish antenna 101.

Figure 2:
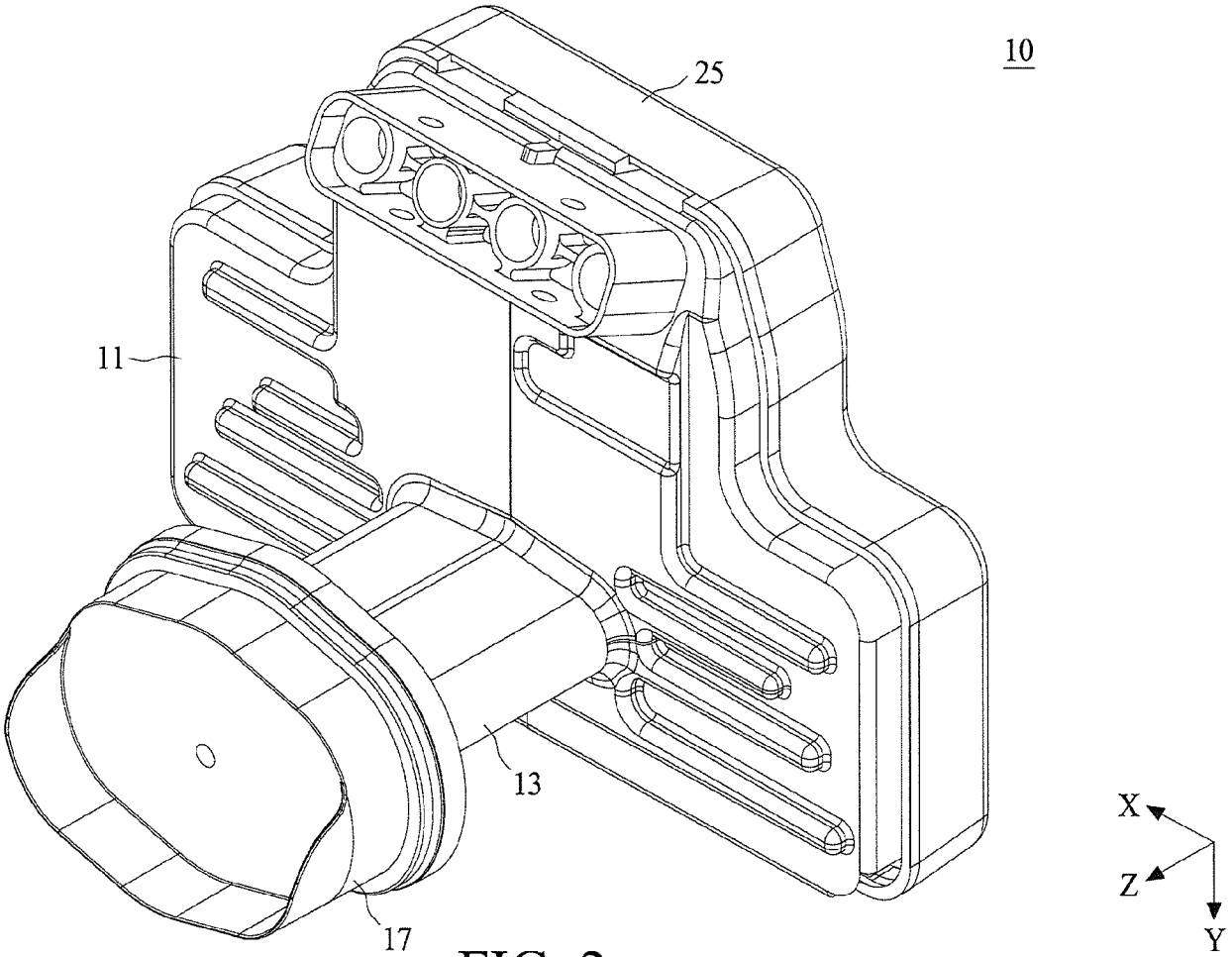
FIG. 2 is an assembled view of a low noise block converter according to one embodiment of the present invention.
Figure 3:
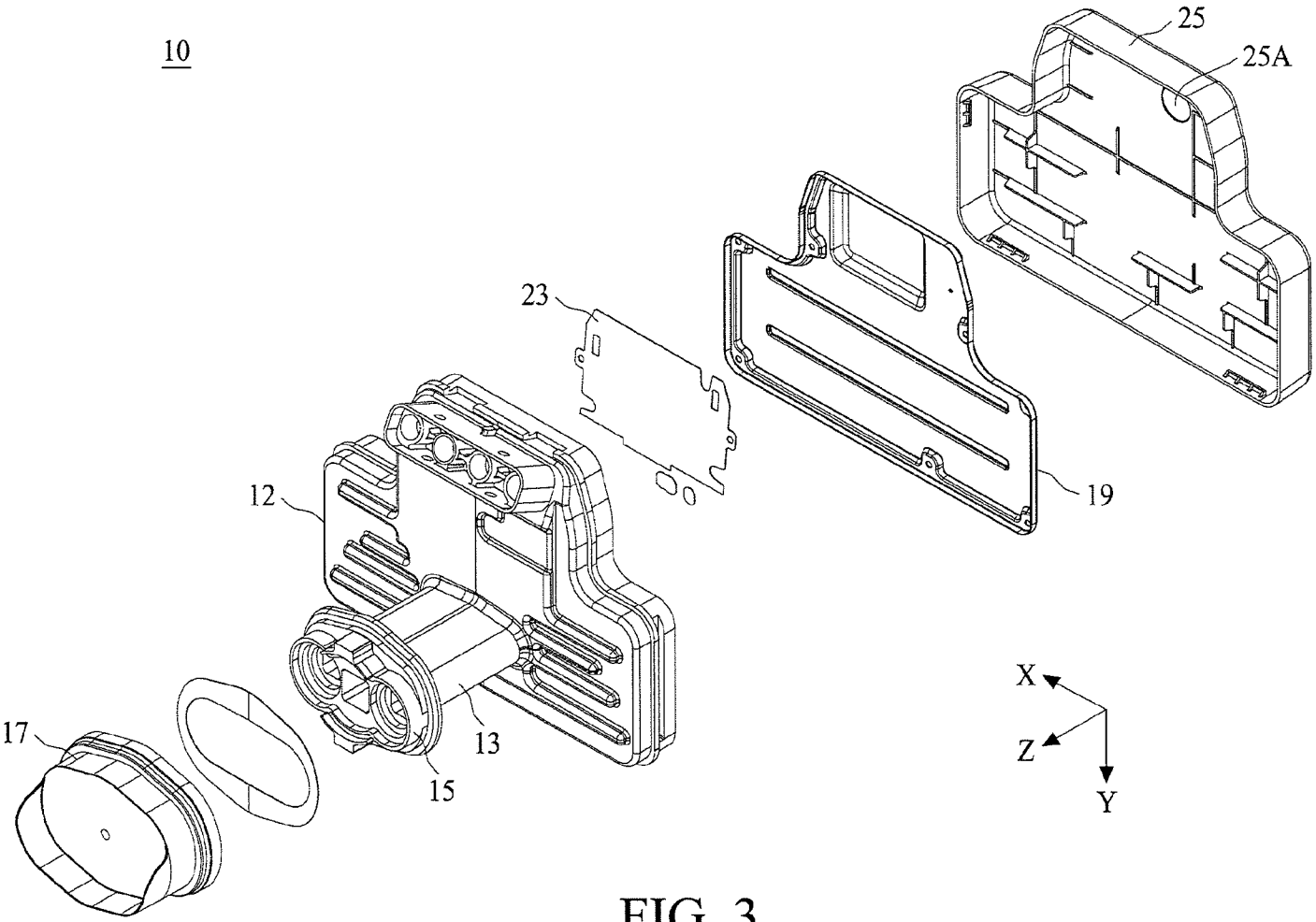
FIG. 3 and FIG. 4 are disassembled views of the low noise block converter in FIG. 2 from the top side and the bottom side respectively.
Figure 4:
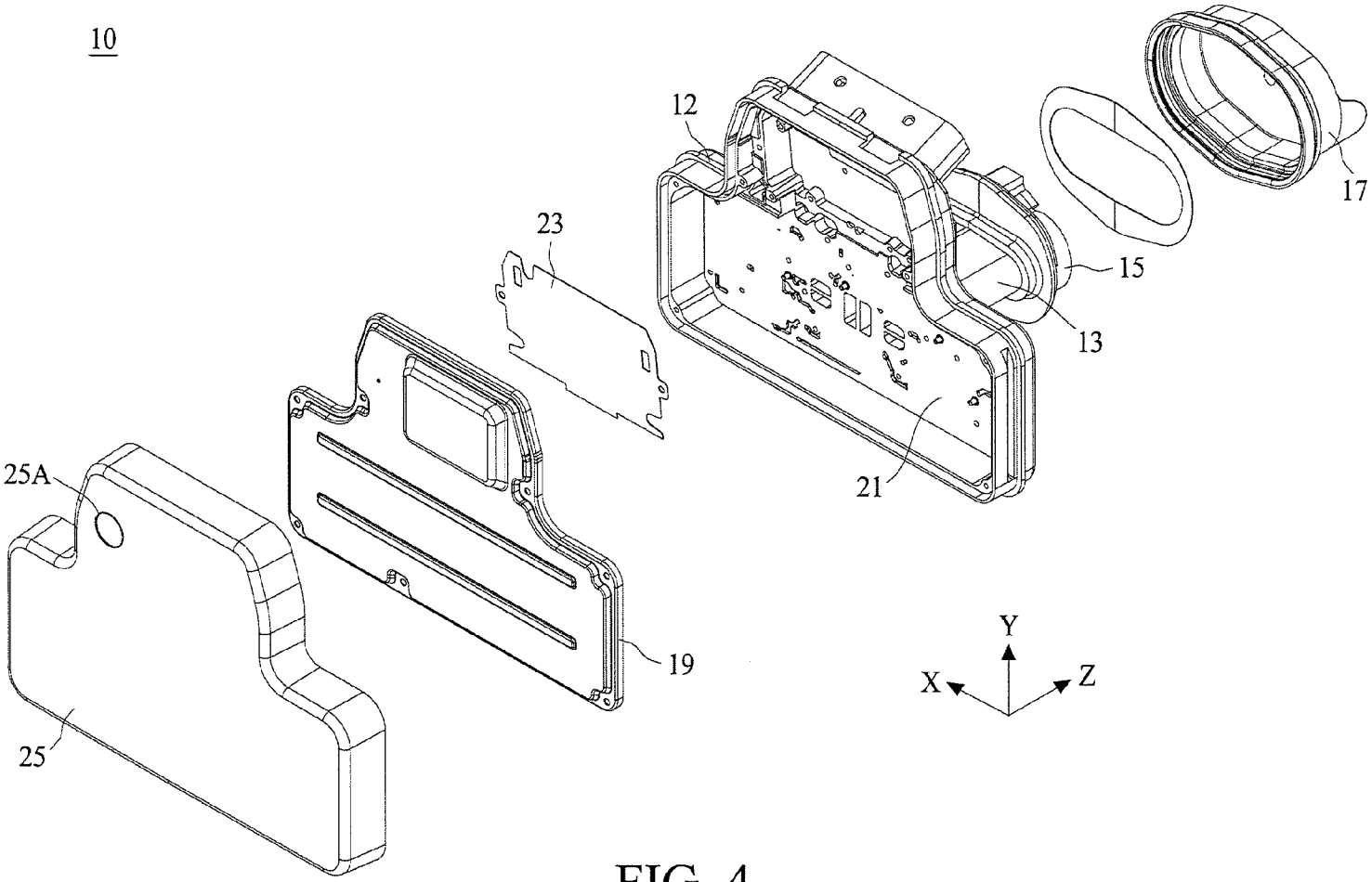

FIG. 2 is an assembled view of a low noise block converter 10 according to one embodiment of the present invention, and FIG. 3 and FIG. 4 are disassembled views of the low noise block converter 10 from the top side and the bottom side respectively. In one embodiment of the present disclosure, the low noise block converter 10 comprises a housing 11 and a feed cap 17 disposed on top of the housing 11. In one embodiment of the present disclosure, the housing 11 includes a base portion 12, at least one feed horn structure 13 protruding from the base portion 12, and a bottom cover 19 attached to a bottom of the base portion 12 so as to form a housing cavity 21. In one embodiment of the present disclosure, the low noise block converter 10 further comprises a circuit board 23 disposed within the housing cavity 21, and a plastic cover 25 attached to a bottom portion of the housing 10, wherein the feed cap 17 is disposed on a feed portion 15 of the at least one feed horn structure 13.

Figure 5:
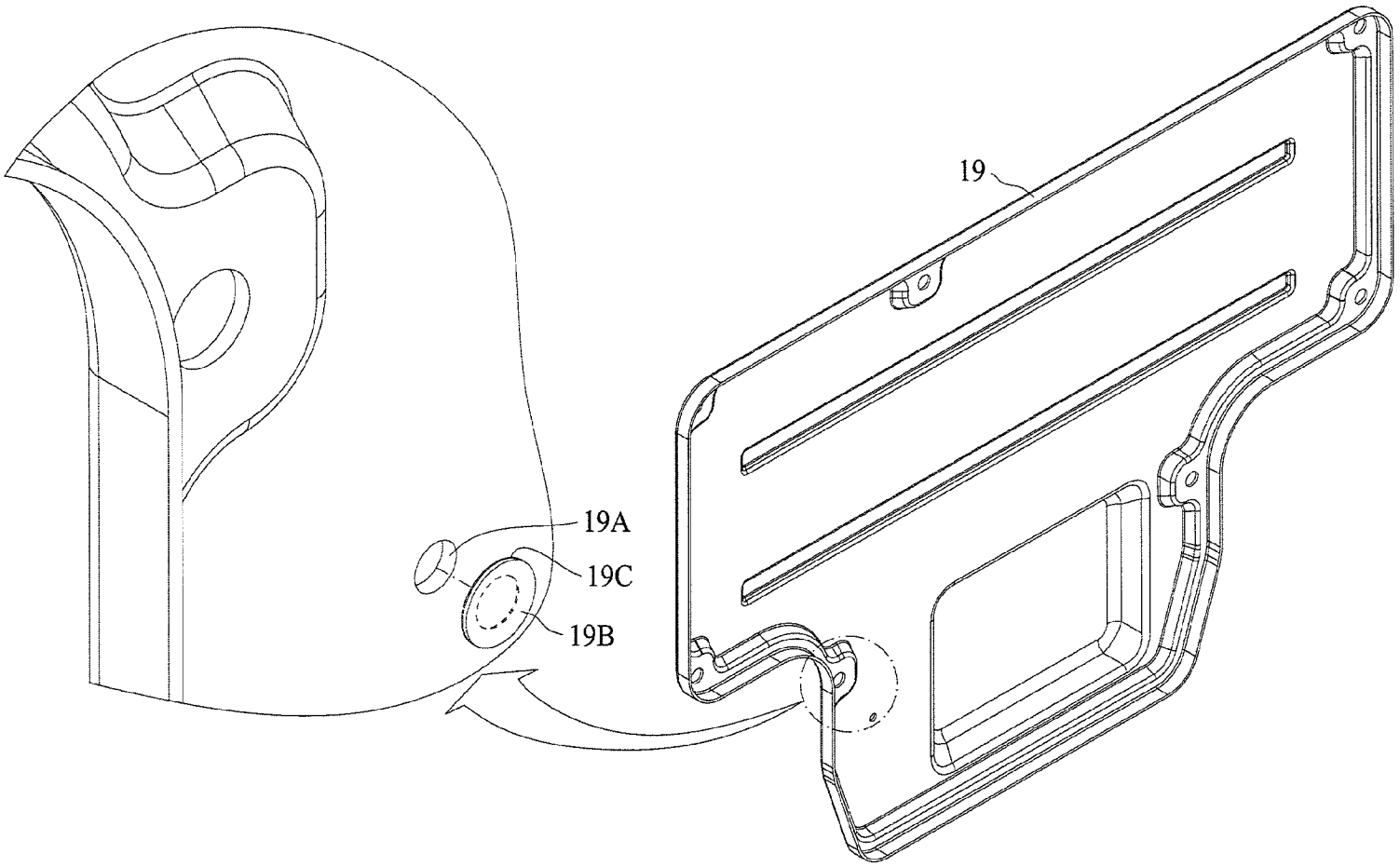
FIG. 5 is a close-up view of a bottom cover of the low noise block converter in FIG. 2 according to one embodiment of the present invention.

FIG. 5 is a close-up view of a bottom cover 19 of the low noise block converter 10 according to one embodiment of the present invention. In one embodiment of the present disclosure, the bottom cover 19 has a vent hole 19A forming a flow path between the housing cavity 21 and the external environment, and an air permeable membrane 19B is disposed over the vent hole 19A and coupled to the bottom cover via an adhesive 19C, wherein the membrane 19B is configured to permit egress of a gas from the housing cavity 21 therethrough. In one embodiment of the present disclosure, the plastic cover 25 includes an aperture 25A corresponding to the vent hole 19A of the bottom cover 19.

In one embodiment of the present disclosure, the air permeable membrane 19B is an aqueous liquid impermeable membrane such as a hydrophobic membrane, and configured to at least meet an ingress protection rating of IEC IP65 and TEC IP67. In one embodiment of the present disclosure, the air permeable membrane 19B is a PTFE (Polytetrafluoroethene).

Figure 6:
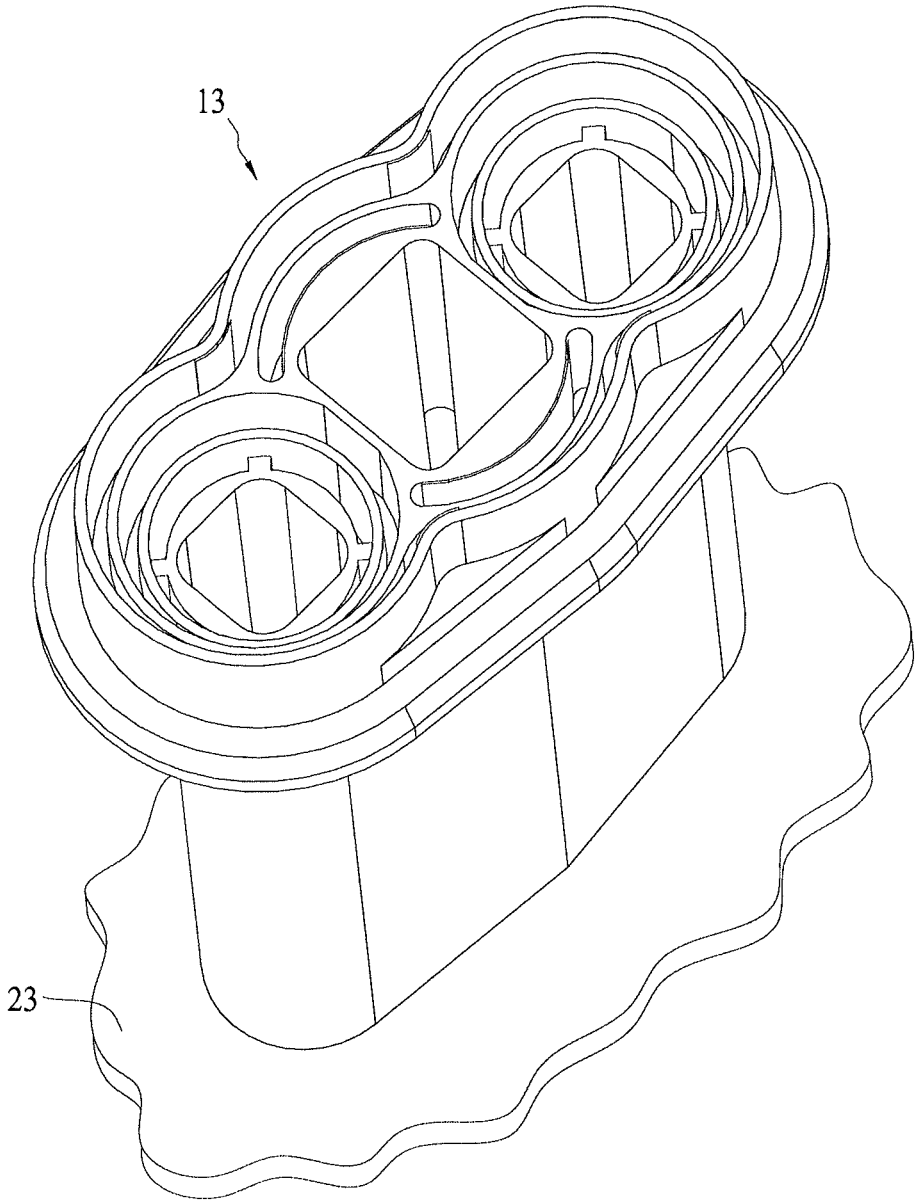
FIG. 6 illustrates a full view of a feed horn structure according to one exemplary embodiment of the present invention.
Figure 7:
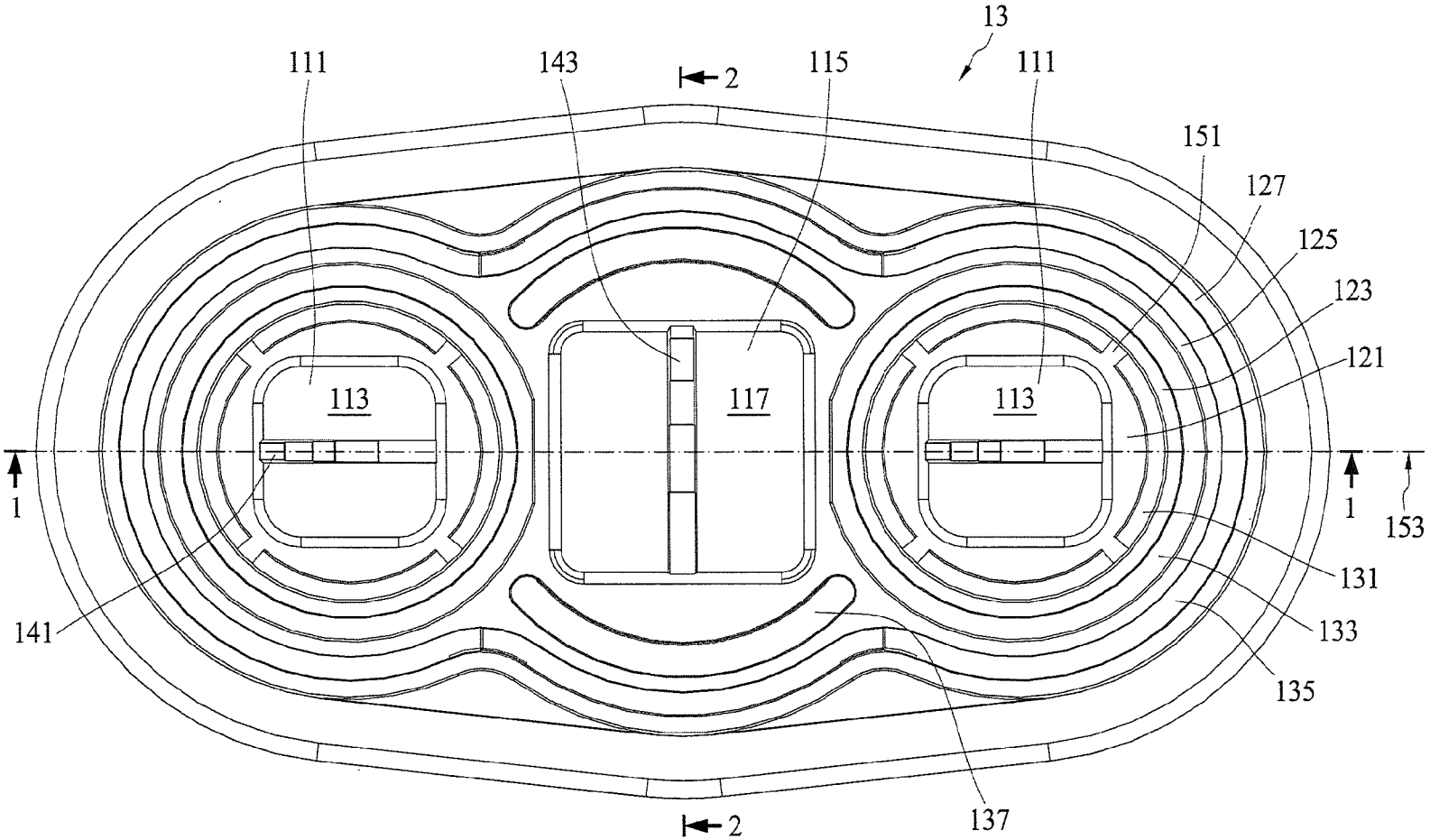
FIG. 7 illustrates a top view of the feed horn structure shown in FIG. 6.
Figure 8:
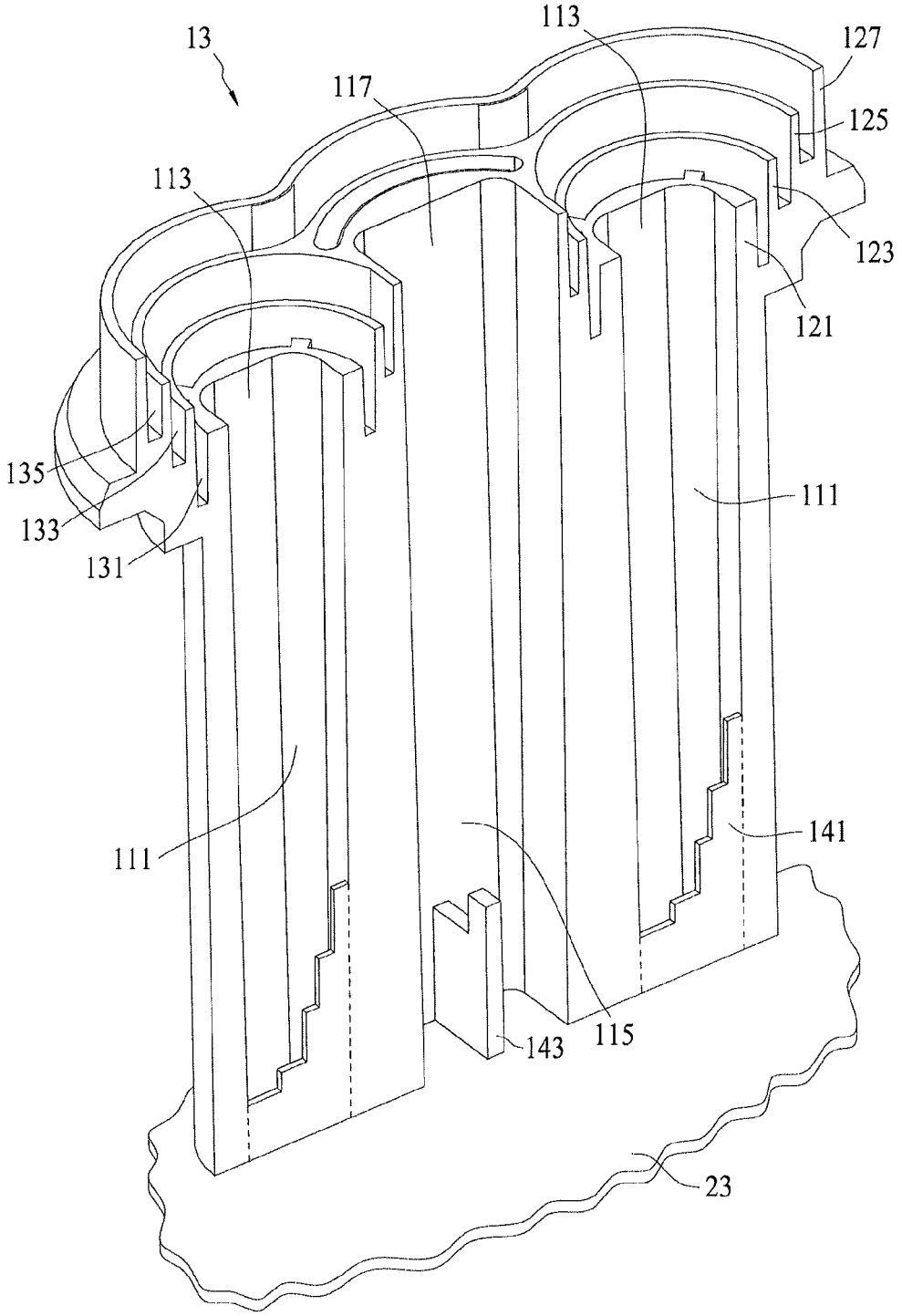
FIG. 8 illustrates a cross-sectional view of the feed horn structure along a sectional line 1-1 in FIG. 7.
Figure 9:
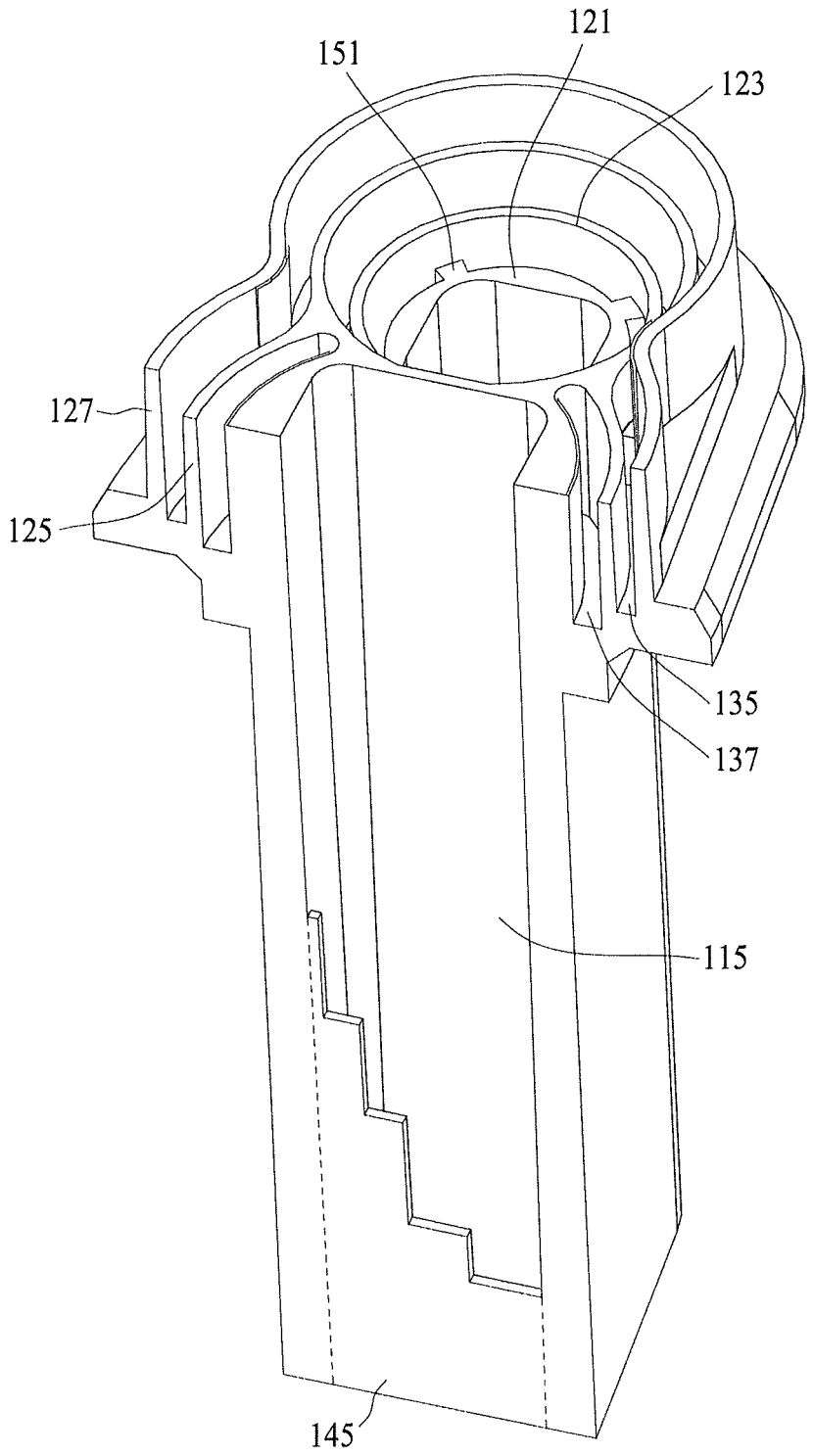
FIG. 9 illustrates a cross-sectional view of the feed horn structure along a sectional line 2-2 in FIG. 7.

FIG. 6 illustrates a full view of the feed horn structure 13 according to one exemplary embodiment of the present invention. FIG. 7 illustrates a top view of the feed horn structure 13 shown in FIG. 6. FIG. 8 illustrates a cross-sectional view of the feed horn structure 13 along a sectional line 1-1 in FIG. 7, and FIG. 9 illustrates a cross-sectional view of the feed horn structure 13 along a sectional line 2-2 in FIG. 7.

Referring to FIG. 6 to FIG. 9, in one embodiment of the present invention, the feed horn structure 13 comprises two first feed horns 111 each having a first upper aperture 113, with a first wall 121 surrounding the first upper aperture 113; a second feed horn 115 disposed between the two first feed horns 111, and the second feed horn 115 having a second upper aperture 117; a second wall 123 surrounding the first wall 121, with a first groove 131 between the second wall 123 and the first wall 121; a third wall 125 surrounding the second wall 123 and the second upper aperture 117, with a second groove 133 between the third wall 25 and the second wall 123; a fourth wall 127 surrounding the third wall 125, with a third groove 135 between the fourth wall 127 and the third wall 125; and a plurality of ribs 151 connecting the first wall 121 and the second wall 123.

In one embodiment of the present invention, the center feed horn 115 receives electromagnetic waves in a frequency band of 12.2-12.7 GHz (Ku 101) from a satellite located at 101 degrees west longitude. The left feed horn 111 receives a beam in a frequency band of 18.3-18.8 and 19.7-20.2 GHz (Ka 103) from a satellite located at 102.8 degrees west longitude. The right feed horn 111 receives a beam in a frequency band of 18.3-18.8 and 19.7-20.2 GHz (Ka 99) from a satellite located at 99.2 degrees west longitude.

In one embodiment of the present invention, the third wall 125 comprises at least one non-circular groove 137 between the second upper aperture 117 and the third groove 125. In one preferred embodiment of the present invention, the non-circular groove 137 is an arc-shaped groove, as shown in FIG. 7. In one embodiment of the present invention, the first upper aperture 113 is rectangular with round corners, and the second upper aperture 117 is also rectangular with round corners. In another embodiment of the present invention, the first upper aperture can be circular or elliptical, and the second upper aperture can be circular or elliptical, as well.

In one embodiment of the present invention, the feed horn structure 13 comprises a first plate 141 disposed in a first bottom aperture of the first feed horn 111. In one preferred embodiment of the present invention, the first plate 141 has a multi-step shape, as shown in FIG. 8. In one preferred embodiment of the present invention, the feed horn structure 13 comprises a second plate 143 disposed in a second bottom aperture of the second feed horn 115. In one preferred embodiment of the present invention, the second plate 145 has a multi-step shape, as shown in FIG. 9. In one embodiment of the present invention, the first plate 141 in the first feed horn 111 and the second plate 145 in the second feed horn 115 are disposed in a perpendicular manner, as shown in FIG. 7.

Referring to FIG. 7, in one embodiment of the present invention, the feed horn structure 13 comprises four ribs 151 separated by 90 degrees. In one preferred embodiment of the present invention, the four ribs 151 are disposed at 45 degrees relative to a horizontal line 153. In one preferred embodiment of the present invention, the rib 151 has a tapered shape with an inner curve and an outer curve, and the width of the rib 151 is preferably 4 degrees. In addition, the four ribs 151 can be positioned at other angles in order to achieve similar effects.

In one embodiment of the present invention, the circuit board 23 is disposed on a terminal portion 13B of the feed horn structure 13, the feed horns 111 include a horn cavity 111A communicating with the housing cavity 21, and the feed horns 113 include a horn cavity 113A communicating with the housing cavity 21.

The temperature variation may increase the volume of the air inside the housing cavity 21, which communicates with the horn cavity 113A and 115A, thereby causing a warp of the feed cap 17 on top of the feed horn structure 13. The nonplanar characteristic (warp) of the feed cap 17 may cause return loss and insertion loss degradation, and the return loss and insertion loss may also vary with respect to the magnitude of the nonplanar characteristic (warp) of the feed cap 17.

Figure 10:
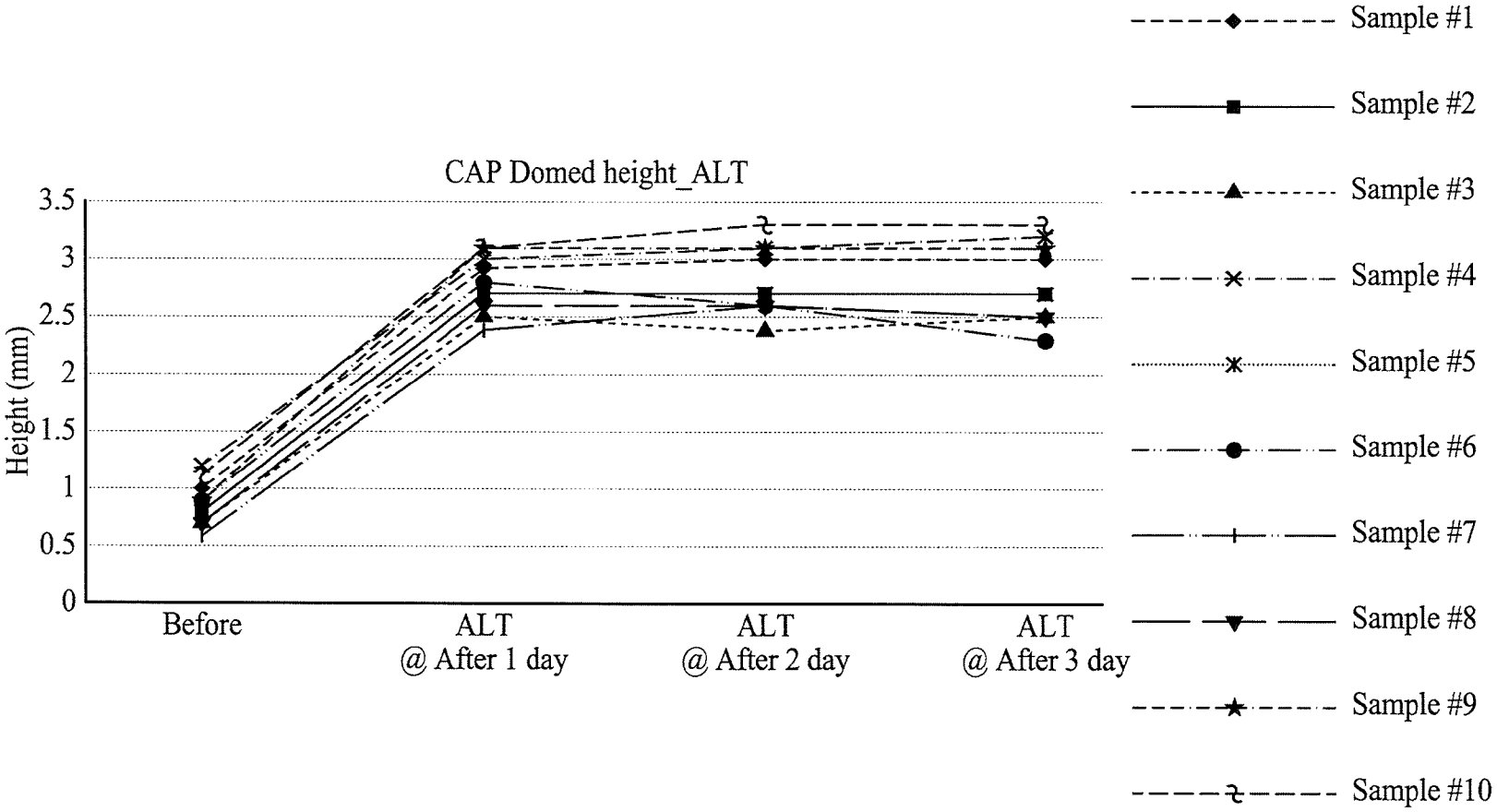
FIG. 10 shows comparative waveforms of the height variation of ten (10) comparative feed caps after temperature cycling testing, wherein the comparative feed caps are attached to low noise block converters having a bottom cover with no vent hole.

FIG. 10 shows comparative waveforms of the height variation of ten (10) comparative feed caps after temperature cycling testing, wherein the comparative feed caps are attached to low noise block converters having a bottom cover with no vent hole. As shown in FIG. 10, without the vent hole, the air pressure imbalance between the housing cavity and the environment will cause the height variation of the feed cap to be about 1.5 mm (from 1 mm to 2.5 mm) after temperature cycling testing.

Figure 11:
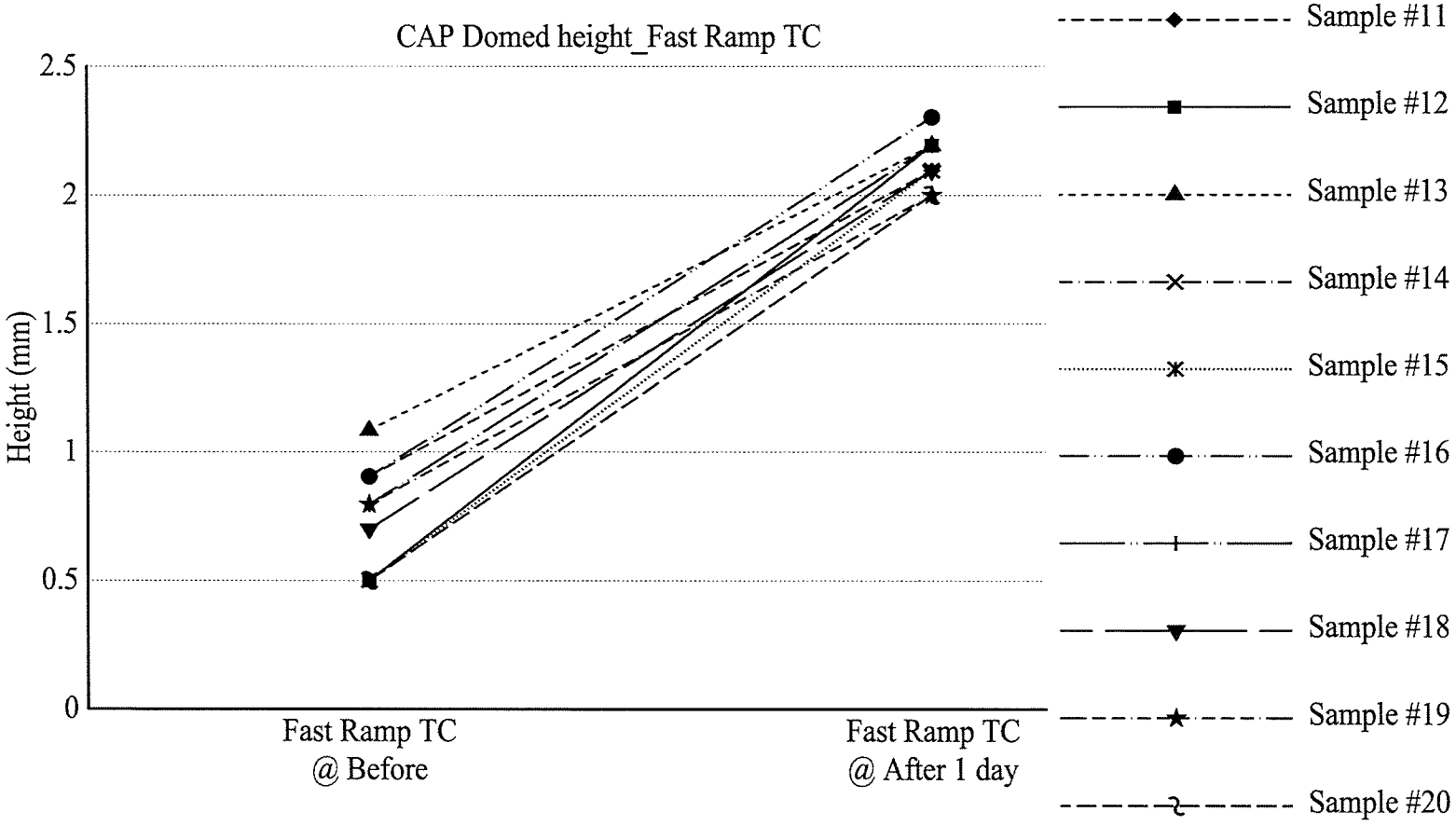
FIG. 11 shows comparative waveforms of the height variation of ten (10) comparative feed caps after ALT (accelerated life testing); wherein the comparative feed caps are attached to low noise block converters having a bottom cover with no vent hole.

FIG. 11 shows comparative waveforms of the height variation of ten (10) comparative feed caps after ALT (accelerated life testing); wherein the comparative feed caps are attached to low noise block converters having a bottom cover with no vent hole. As shown in FIG. 11, without the vent hole, the air pressure imbalance between the housing cavity and the environment will cause the height variation of the feed cap to be about 2 mm (from 1.5 mm to 3.5 mm) after ALT.

Figure 12:
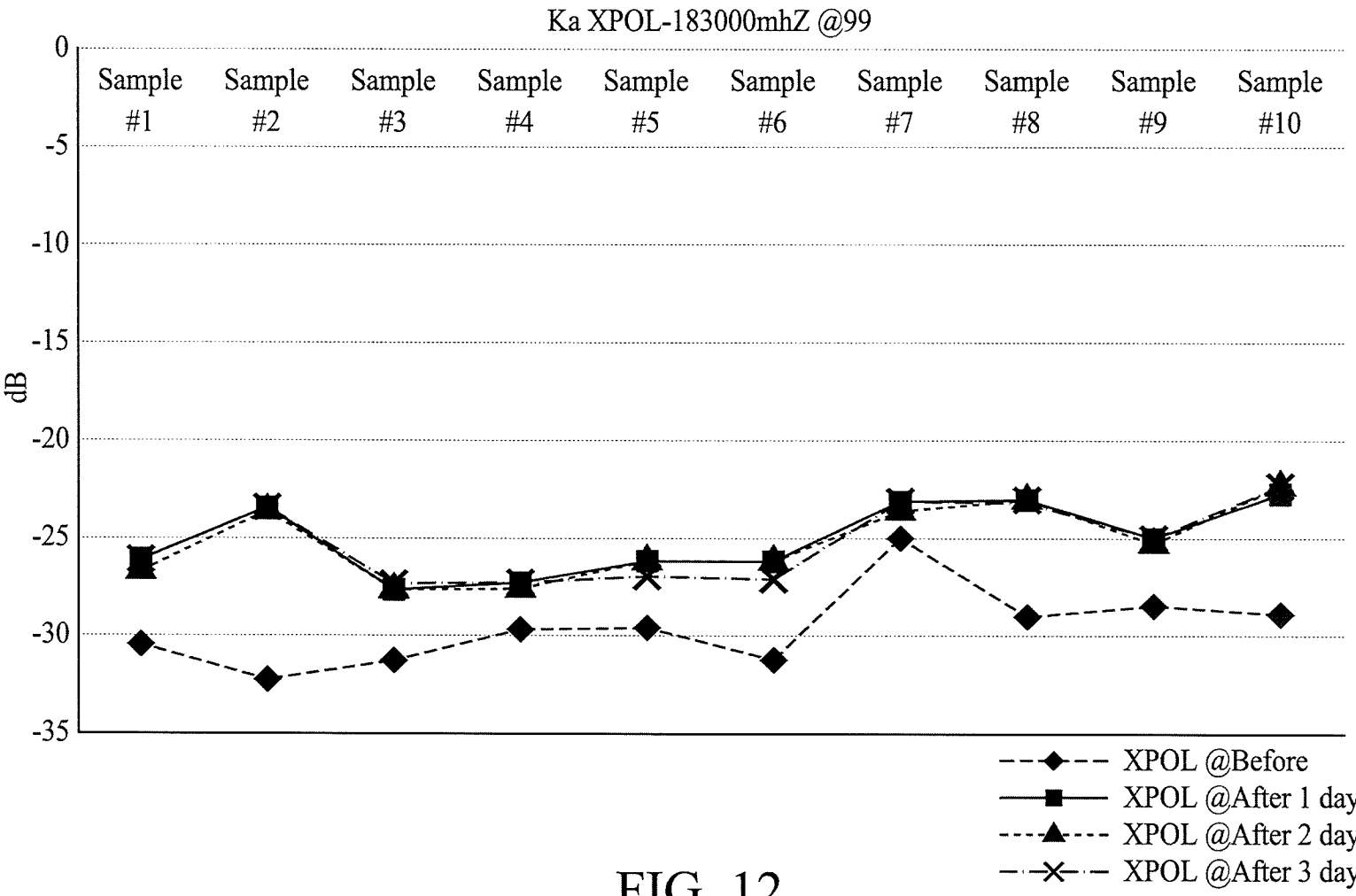
FIG. 12 shows comparative waveforms of the cross polarization isolation (also referred to as x-polarization or XPOL isolation) of the comparative low noise block converters equipped with the ten (10) feed caps in FIG. 11 after ALT.

FIG. 12 shows comparative waveforms of the cross polarization isolation (also referred to as x-polarization or XPOL isolation) of the comparative low noise block converters equipped with the ten (10) feed caps in FIG. 11 after ALT. For the XPOL isolation characteristics, the more negative in amplitude (dB), the better the performance of the low noise block converters; and the performance of the low noise block converters degrades as the amplitude (dB) shift from the negative toward zero. As shown in FIG. 12, the XPOL isolation characteristics of the ten comparative low noise block converters all degrade by about 2-3 dB, which is caused by the height variation of the feed cap due to the air pressure imbalance between the housing cavity and the environment.

Figure 13:
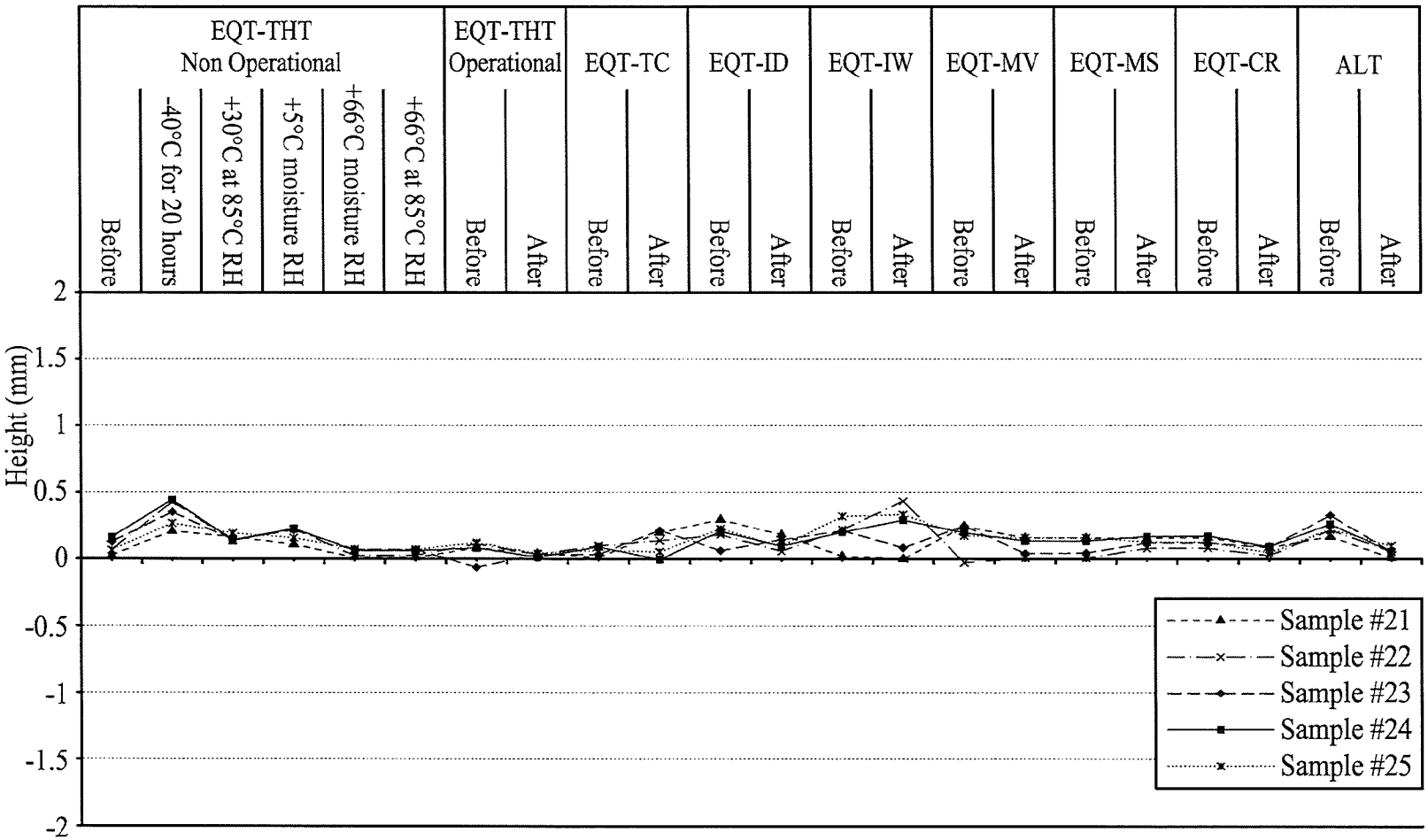
FIG. 13 shows exemplary waveforms of the height variation of five (5) exemplary feed caps after several types of environmental tests, wherein the five (5) exemplary feed caps are attached to low noise block converters having a bottom cover with a vent hole.

FIG. 13 shows exemplary waveforms of the height variation of five (5) exemplary feed caps after several types of environmental tests, wherein the five (5) exemplary feed caps are attached to low noise block converters having a bottom cover with a vent hole. The environmental tests include temperature-humidity testing (THT), temperature cycling (TC), impacting dust (ID), impacting water (IW), mechanical vibration (MV), mechanical shock (MS), corruption (CR), and accelerated life testing (ALT). As clearly shown in FIG. 13, with the vent hole in the bottom cover of the low noise block converters, the air pressure imbalance between the housing cavity and the environment can be decreased, and the height variations of the five (5) exemplary feed caps are all well controlled within 0-0.5 mm after performing all environmental tests.

Figure 14:
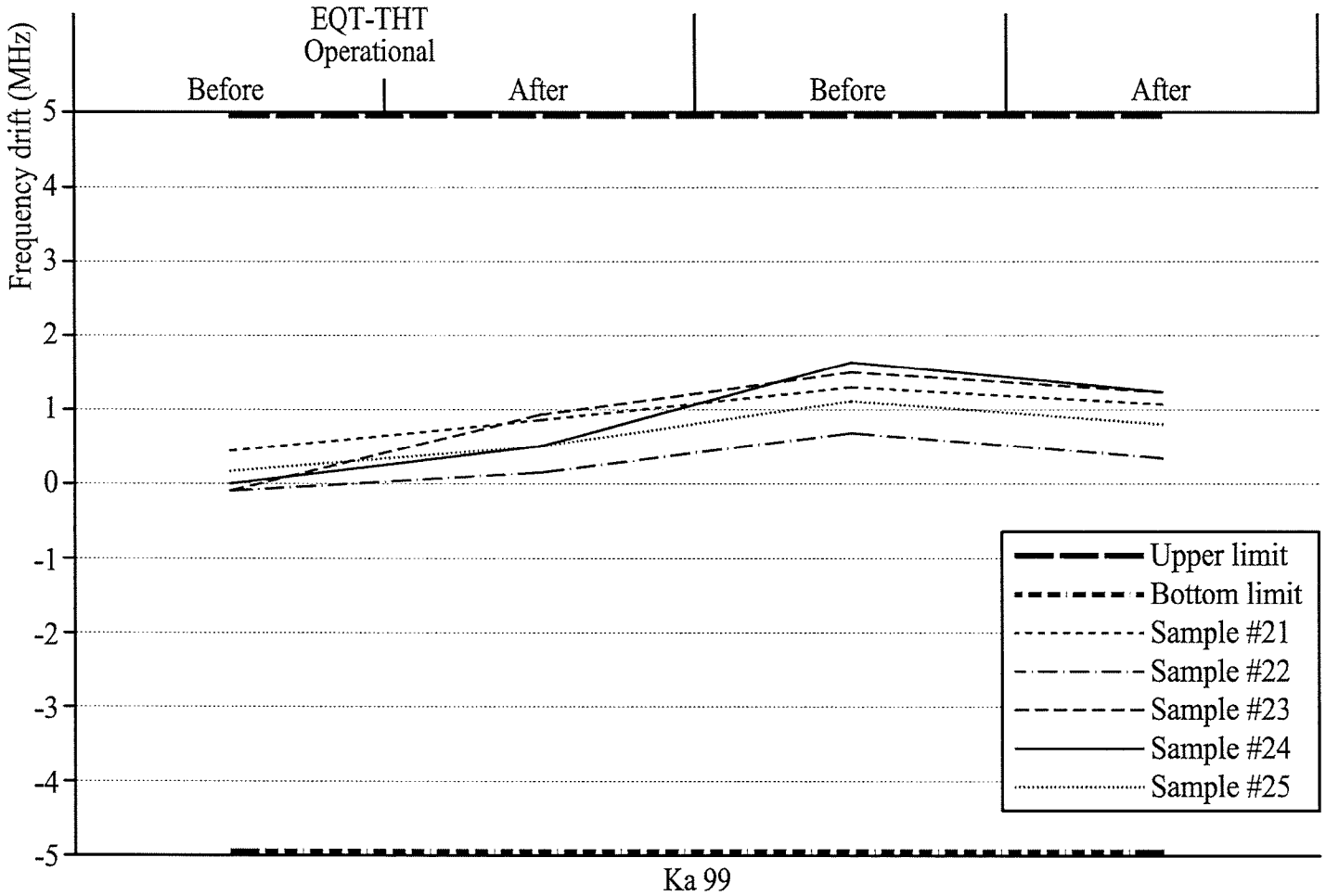
FIGS. 14-16 are exemplary waveforms showing the frequency-drift of the low noise block converters equipped with a bottom cover having a vent hole after several types of environmental tests, wherein the specification has a bottom limit of −5 MHz and an upper limit of 5 MHz on the frequency-drift characteristic.
Figure 15:
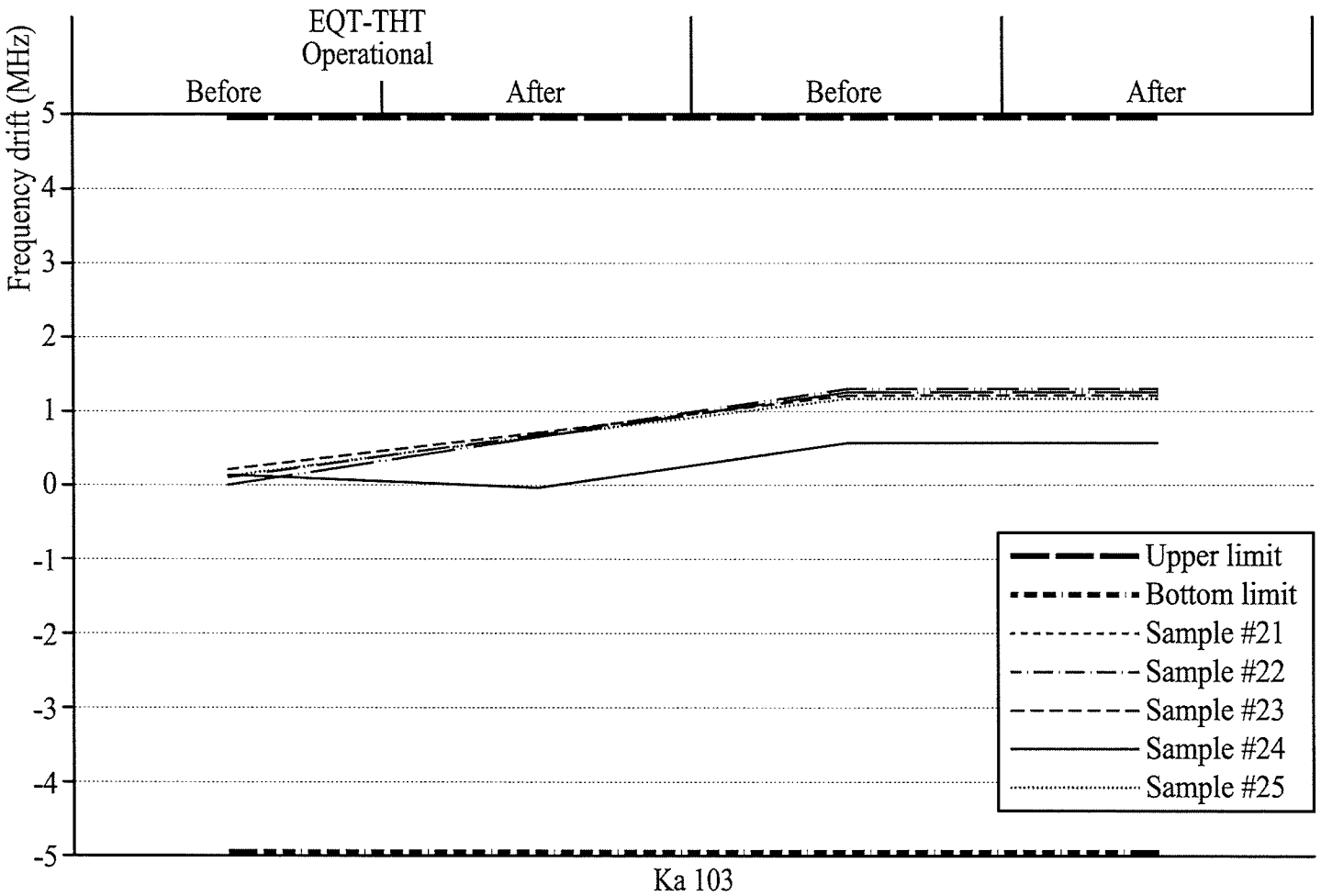
Figure 16:
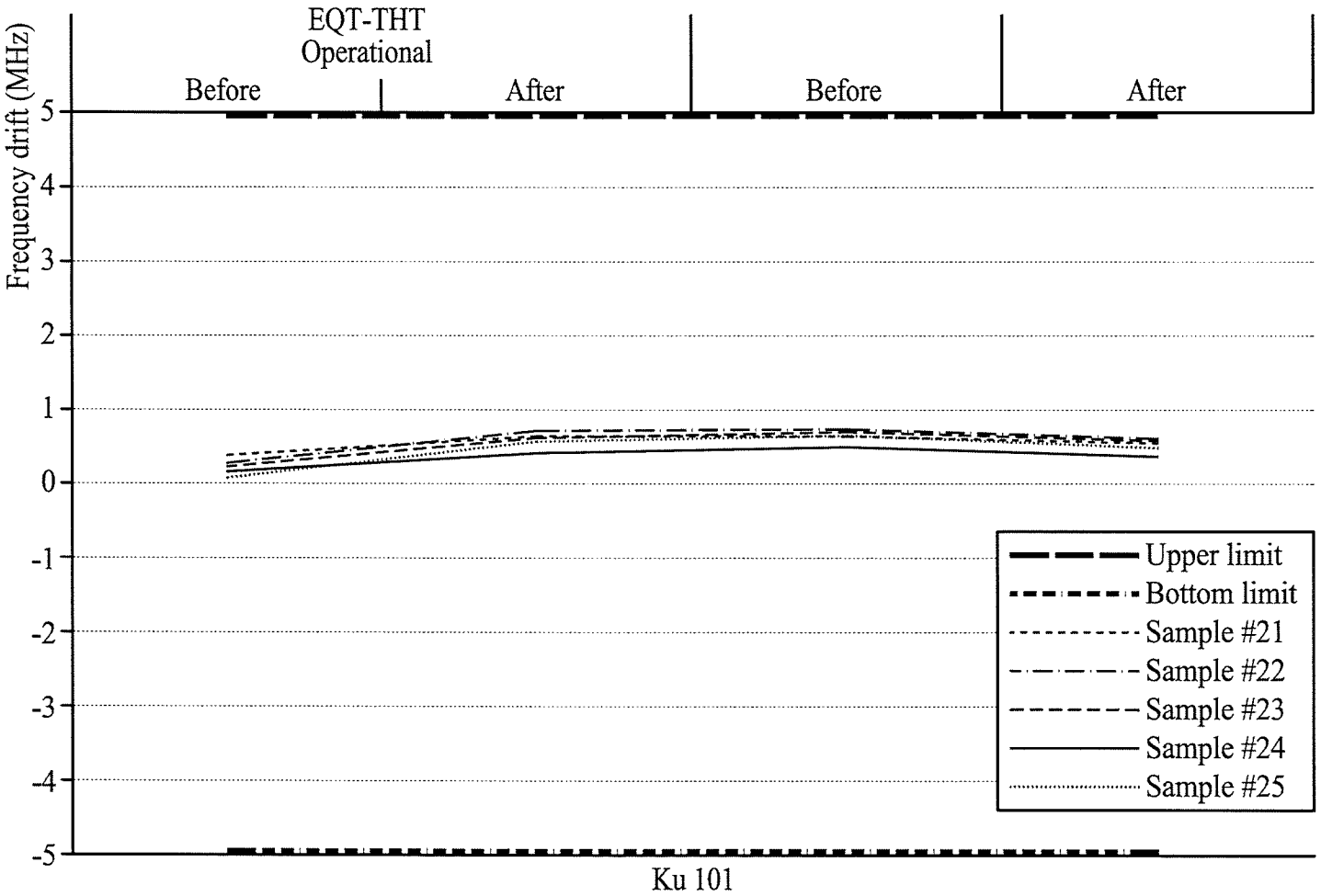

FIGS. 14-16 are exemplary waveforms showing the frequency drift of the low noise block converters equipped with a bottom cover having a vent hole after several types of environmental tests, wherein the specification has a bottom limit of −5 MHz and an upper limit of 5 MHz on the frequency-drift characteristic. As shown in FIGS. 14-16, with the vent hole in the bottom cover of the low noise block converters, the air pressure imbalance between the housing cavity and the environment can be decreased, the height variations of the five (5) exemplary feed caps are all well controlled within 0-0.5 mm after performing all environmental tests, and the frequency-drift characteristic for the feed horns 111 (Ka 99 and Ka 103) and the feed horns 115 (Ku 105) are all well controlled within the specification after performing all environmental tests.

Figure 17:
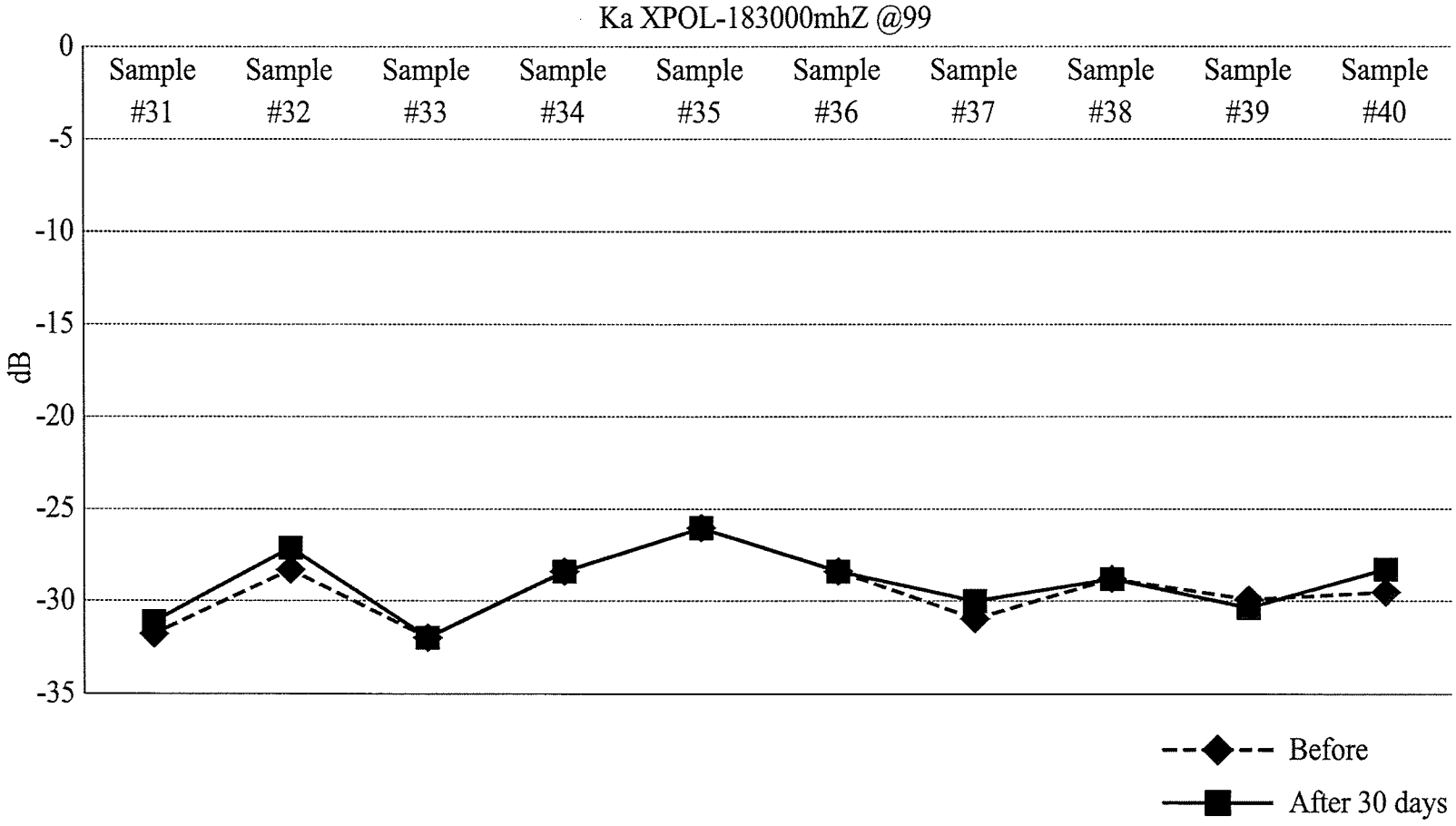
FIG. 17 shows exemplary waveforms of the cross polarization isolation (XPOL isolation) of ten (10) exemplary low noise block converters equipped with the bottom cover having a vent hole after ALT.

FIG. 17 shows exemplary waveforms of the cross polarization isolation (XPOL isolation) of ten (10) exemplary low noise block converters equipped with the bottom cover having a vent hole after ALT. As shown in FIG. 17, the XPOL isolation characteristics of the ten comparative low noise block converters all remains substantially at the same level, even after 30-days, because the design for the bottom cover with the vent hole effectively decreases the height variation of the feed cap due to the air pressure imbalance between the housing cavity and the environment.

Due to the design for the bottom cover with the vent hole forming the flow path between the housing cavity and the external environment, the height variation of the feed cap caused by the air pressure imbalance between the housing cavity and the environment can be decreased. Consequently, the XPOL isolation characteristics of the low noise block converter and the outdoor unit can be well controlled so as to have a consistent communication quality even if the temperature or pressure of the environment changes.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A low noise block converter, comprising:

a housing including a base portion and at least one feed horn protruding from the base portion, and a bottom cover attached to a bottom of the base portion so as to form a housing cavity, wherein the bottom cover has a vent hole forming a flow path between the housing cavity and an external environment;

a feed cap disposed on a feed portion of the at least one feed horn;

a circuit board disposed within the housing cavity; and an air permeable membrane disposed over the vent hole and coupled to the bottom cover via an adhesive, wherein the membrane is configured to permit egress of a gas from the housing cavity therethrough.

2. The low noise block converter of claim 1, further comprising a plastic cover attached to a bottom portion of the housing, wherein the plastic cover includes an aperture corresponding to the vent hole of the bottom cover.

3. The low noise block converter of claim 1, wherein the air permeable membrane is an aqueous liquid impermeable membrane.

4. The low noise block converter of claim 1, wherein the air permeable membrane is configured to at least meet an ingress protection rating of IEC IP65.

5. The low noise block converter of claim 1, wherein the air permeable membrane is configured to at least meet an ingress protection rating of IEC IP67.

6. The low noise block converter of claim 1, wherein the air permeable membrane is a hydrophobic membrane.

7. The low noise block converter of claim 1, comprising:

a first feed horn having a first upper aperture with a first wall surrounding the first upper aperture; and a second feed horn disposed in parallel to the first feed horn, in which the second feed horn has a second upper aperture.

8. The low noise block converter of claim 7, comprising at least two first feed horns, and the second feed horn being disposed between the at least two first feed horns.

9. The low noise block converter of claim 1, wherein the circuit board is disposed on a terminal portion of the at least one feed horn.

10. The low noise block converter of claim 1, wherein the at least one feed horn includes a horn cavity communicating with the housing cavity.

11. An outdoor unit, comprising:

a dish antenna; and a low noise block converter positioned at a focus point of the dish antenna, the low noise block converter comprising:

a housing including a base portion, at least one feed horn protruding from the base portion, and a bottom cover attached to a bottom of the base portion so as to form a housing cavity, wherein the bottom cover has a vent hole forming a flow path between the housing cavity and an external environment;

a feed cap disposed on a feed portion of the at least one feed horn;

a circuit board disposed within the housing cavity; and an air permeable membrane disposed over the vent hole and coupled to the bottom cover via an adhesive, wherein the membrane is configured to permit egress of a gas from the housing cavity therethrough.

12. The outdoor unit of claim 11, further comprising a plastic cover attached to a bottom portion of the housing, wherein the plastic cover includes an aperture corresponding to the vent hole of the bottom cover.

13. The outdoor unit of claim 11, wherein the air permeable membrane is an aqueous liquid impermeable membrane.

14. The outdoor unit of claim 11, wherein the air permeable membrane is configured to at least meet an ingress protection rating of IEC IP65.

15. The outdoor unit of claim 11, wherein the air permeable membrane is configured to at least meet an ingress protection rating of IEC IP67.

16. The outdoor unit of claim 11, wherein the air permeable membrane is a hydrophobic membrane.

17. The outdoor unit of claim 11, comprising:

a first feed horn having a first upper aperture with a first wall surrounding the first upper aperture; and a second feed horn disposed in parallel to the first feed horn, in which the second feed horn has a second upper aperture.

18. The outdoor unit of claim 17, comprising at least two first feed horns, and the second feed horn being disposed between the at least two first feed horns.

19. The outdoor unit of claim 11, wherein the circuit board is disposed on a terminal portion of the at least one feed horn.

20. The outdoor unit of claim 11, wherein the at least one feed horn includes a horn cavity communicating with the housing cavity.

* * * * *